US006610951B1

(12) United States Patent
Lai

(10) Patent No.: US 6,610,951 B1
(45) Date of Patent: Aug. 26, 2003

(54) FORWARD/BACKWARD SWITCH PROTECTIVE STRUCTURE FOR REMOTELY CONTROLLABLE CAR

(75) Inventor: Aling Lai, Taichung (TW)

(73) Assignee: Thunder Tiger Corporation, Taichung (TW)

( * ) Notice: Subject to any disclaimer, the term of this patent is extended or adjusted under 35 U.S.C. 154(b) by 0 days.

(21) Appl. No.: 10/208,708

(22) Filed: Jul. 30, 2002

(51) Int. Cl.[7] ..... H01H 3/40
(52) U.S. Cl. ..... 200/501; 192/43.1
(58) Field of Search ..... 200/501, 17 R, 200/80 R, 61.88, 330, 336, 801–805, 500; 192/129 A, 116.5–150, 43.1

(56) References Cited

U.S. PATENT DOCUMENTS 5,274,987 A * 1/1994 Wiener ..... 56/14.8
5,435,797 A * 7/1995 Harris ..... 477/180
5,740,892 A * 4/1998 Huang ..... 192/43.1

* cited by examiner

*Primary Examiner*—Lincoln Donovan
*Assistant Examiner*—Lisan Klaus

(57) ABSTRACT

A forward/backward switch protective structure for a remotely controllable car, including an output shaft having a differential section. Two gears are respectively rotatably disposed at two ends of the differential section. A seat body is fixedly disposed on the differential section and a shade body is fitted on the differential section. The shade body is formed with a differential engaging hole for the differential section to fit therethrough. A shade body is controlled by a shifting mechanism and movable along the differential section. The shade body is formed with an internal chamber for receiving therein the seat body. The chamber is formed with annular grooves. When the engaging sections of the shade body are respectively engaged with the stop sections of the gears, the annular grooves respectively correspond to the throw plates of the seat body. When outward centrifugally extended, the throw plates are inserted into the annular grooves to prevent the shade body from moving.

5 Claims, 5 Drawing Sheets

FORWARD/BACKWARD SWITCH PROTECTIVE STRUCTURE FOR REMOTELY CONTROLLABLE CAR

BACKGROUND OF THE INVENTION

A present invention is related to a forward/backward switch protective structure for a remotely controllable car. When a throw plates of the output shaft are outward centrifugally extended, a shade body is located and prevented from moving. Therefore, respective components are protected from being impacted and worn out due to instantaneous switching between forward and backward rotation.

FIGS. 7 and 8 show a forward/backward power coupler of a remotely controllable car. A forward gear 82 and a backward gear 83 are disposed on an output shaft 81. The forward and backward gears 82, 83 are driven by a gear set 85 driven the same engine 84. In addition, the forward and backward gears 82, 83 are respectively provided with clutch seats 821, 831. The clutch seats 821, 831 respectively have clutch plates 822, 832. The output shaft 81 has a differential section 811 between the forward and backward gears 82, 83. A clutch shade 86 is fitted on the differential section 811. The clutch shade 86 has a differential hole 860 through which the differential section 811 is fitted. The clutch shade 86 is formed with annular grooves 861, 862 respectively corresponding to the clutch plates 822, 832 of the forward and backward gears 82, 83. When outward extended, the clutch plates 822, 832 are inserted into the annular grooves 861, 862 for driving the clutch shade 86 to drive the output shaft 81.

In addition, the clutch shade 86 has an annular groove 863 in which a shifting plate 87 is inlaid. A servo (not shown) drives the shifting plate 87 to push the clutch shade 86.

In a state that the clutch shade 86 covers the clutch seat 821 of the forward gear 82 as shown in FIG. 7, when the engine 84 drives the gear set 85 to rotate the forward gear 82, the clutch plate 822 in the clutch seat 821 will centrifugally extend outward to abut against inner edge of the annular groove 861 of the clutch shade 86 to further drive the clutch shade 86 for driving the output shaft 81, making the remotely controllable car move forward.

When the rotational speed of the engine 84 is reduced and the rotational speed of the forward gear 82 is slowed down, the spring 823 in the clutch seat 821 will push the clutch plate 822 and restore the clutch plate 822 into the clutch seat 821 without contacting with the clutch shade 86 as shown in FIG. 8. At this time, the servo can drive the shifting plate 87 to push the clutch shade 86 to a position where the clutch shade 86 covers the clutch seat 831 of the backward gear 83. Then, when the backward gear 83 is such rotated that the clutch plate 832 extends outward to contact with the annular groove 862 of the clutch shade 86, the clutch shade 86 is driven in reverse direction to backward drive the output shaft 81, whereby the remotely controllable car is moved backward.

However, when the clutch plate 822 is restored into the clutch seat 821 without contacting with the clutch shade 86, the clutch shade 86 and the output shaft 81 are still in a not driven and freely rotatable state. Therefore, the remotely controllable car will inertially move forward. In other words, when the clutch shade 86 is pushed by the shifting plate 87 to the position where the clutch shade 86 covers the clutch seat 831 of the backward gear 83, the clutch shade 86 and the output shaft 81 still inertially rotate forward. However, the engine 84 is able to instantaneously stop operating and then operate to a high speed state. At this time, the backward gear 83 is driven to make the clutch plate 832 extend outward. When the clutch plate 832 of the backward gear 83 contacts with the annular groove 862 of the still forward rotating clutch shade 86, the backward rotating clutch plate 832 will suffer a very great friction in reverse direction. Accordingly, the clutch plate 832 is easy to be quickly worn out and the backward gear 83 and the gear set 85 will bear considerably great reaction force. Similarly, when the clutch shade 86 is switched from backward state to forward state, the above abnormal wear and reaction force will also take place. As a result, the clutch plates 822, 832 and the gear set 85 will be quickly worn out to shorten the using life of the transmission mechanism.

Furthermore, the output power of the engine 84 is transmitted by the gear set 85 to the clutch plate 822 or 832 and then by means of the frictional contact between the clutch plate and the clutch shade 86, the clutch shade 86 drives the output shaft 81 to rotate. The frictional loss between the two clutch plates 822, 832 and the clutch shade 86 will lead to declination of the output power of the engine 84. Therefore, the power can be hardly truly transmitted. This seriously affects the performance of the remotely controllable car, especially in a race.

There is no design for reducing friction between the clutch shade 86 and the shifting plate 87. In other words, the quicker the rotational speed of the clutch shade 86 is, the greater the frictional loss between the shifting plate 87 and the clutch shade 86 is. This increases unnecessary power loss.

SUMMARY OF THE INVENTION

It is therefore a primary object of the present invention to provide a forward/backward switch protective structure for remotely controllable car. Two throw plates are pivotally disposed in a seat body fixed on the output shaft. When the output shaft rotates, the throw plats are outward centrifugally extended and inserted into the annular grooves of a shade body to prevent the shade body from moving and avoid switch between forward and backward rotation. Therefore, the respectively transmission components are protected.

It is a further object of the present invention to provide the above forward/backward switch protective structure in which the differential section of the output shaft is fitted in the corresponding differential engaging hole of the shade body and the engaging sections of the shade body are respectively engaged with the stop sections of the forward and backward gears. Therefore, the power can be truly and directly transmitted from the forward and backward gears via the shade body to the output shaft.

It is still a further object of the present invention to provide the above forward/backward switch protective structure in which the arched insertion member of the shifting mechanism is located by both the link and the insertion rod. Therefore, when inserted into the rail of the shade body, the insertion member will not deflect to contact with the shade body. Accordingly, when the output shaft rotates, the friction between the shade body and the insertion member is avoided.

The present invention can be best understood through the following description and accompanying drawings wherein:

DETAILED DESCRIPTION OF THE PREFERRED EMBODIMENT

Figure 1:
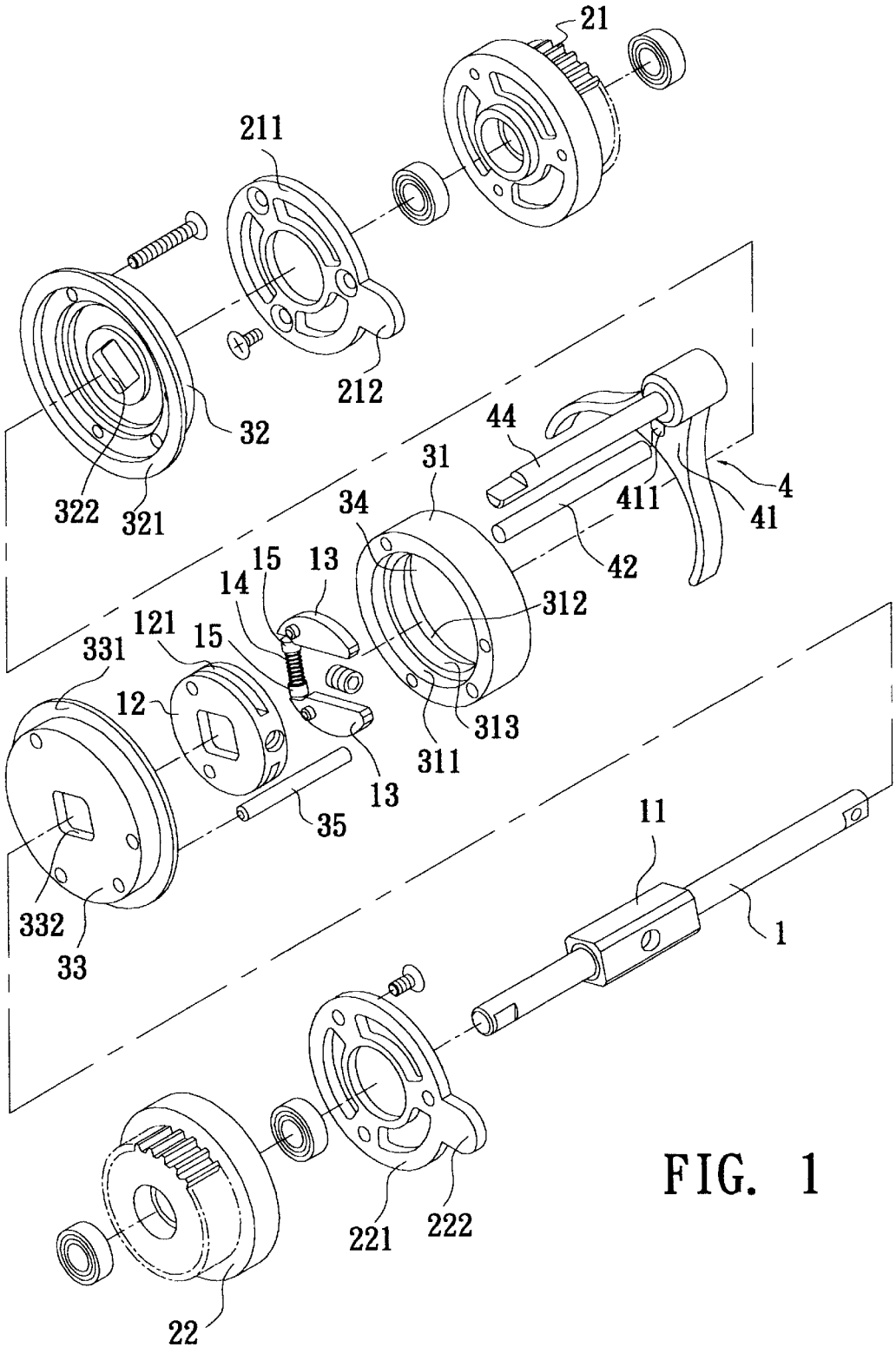
FIG. 1 is a perspective exploded view of the present invention.

Please refer to FIGS. 1 to 4. The present invention includes an output shaft 1 having a differential section 11. A forward gear 21 and a backward gear 22 are respectively rotatably disposed at two ends of the differential section 11. One side of each of the forward and backward gears 21, 22 adjacent to the differential section 11 is coupled with a stop board 211, 221. The stop boards 211, 221 respectively have stop sections 212, 222 radially outward projecting from the forward and backward gears 21, 22.

A seat body 12 is fixedly disposed on the differential section 11. The seat body 12 is formed with two symmetrical receiving channels 121. A throw plate 13 is pivotally disposed in each receiving channel 121. A spring 14 is disposed in the seat body 12 between the two throw plates 13. Two ends of the spring 14 respectively push two projecting blocks 15 to contact with the two throw plates 13. In normal state, the two throw plates 13 are retracted in the receiving channels 121 of the seat body 12.

A hollow shade body 3 is fitted on the differential section 11. The shade body 3 includes a ring body 31 two sides of which are coupled with two cover bodies 32, 33. One side of each of the cover bodies 82, 33 adjacent to the ring body 31 is formed with an annular stop wall 321, 331 defining therebetween a rail 30. In addition, the two cover bodies 32, 33 and the ring body 31 together define a chamber 34. The cover bodies 32, 33 are respectively formed with engaging holes 322, 332 corresponding to the cross-section of the differential section 11, whereby the differential section 11 is fitted through the engaging holes 322, 332.

A rod 35 is axially passed through the shade body 3 corresponding to the stop sections 212, 222 of the forward and backward gears 21, 22. Two ends of the rod 35 extending out of the shade body 3 respectively form two engaging sections 351, 352.

The shade body 3 is controlled by a shifting mechanism 4 and movable along the differential section 11. The shifting mechanism 4 includes an arched insertion member 41 having an extending link 44 coupled with a servo (not shown). The insertion member 41 is formed with a slot 411 in which an insertion rod 42 is inserted. When the insertion member 41 is inserted in the rail 30, the link 44 and the insertion rod 42 together locate the insertion member 41 and prevent the insertion member 41 from contacting with the ring body 31. The insertion member 41 is driven by the servo via the link 44 for pushing the shade body 3 to move along the differential section 11, whereby the engaging sections 351, 352 of the shade body 3 can respectively engage with the stop sections 212, 222 outward projecting from the forward and backward gears 21, 22. The chamber 34 of the shade body 3 is formed with annular grooves 311, 312. When the engaging sections 351, 352 respectively engage with the stop sections 212, 222, the annular grooves 311, 312 respectively correspond to the throw plates 13 of the seat body 12, whereby when outward extended, the throw plates 13 are inserted into the annular grooves 311, 312. The two annular grooves 311, 312 define therebetween a stop wall 313.

Figure 2:
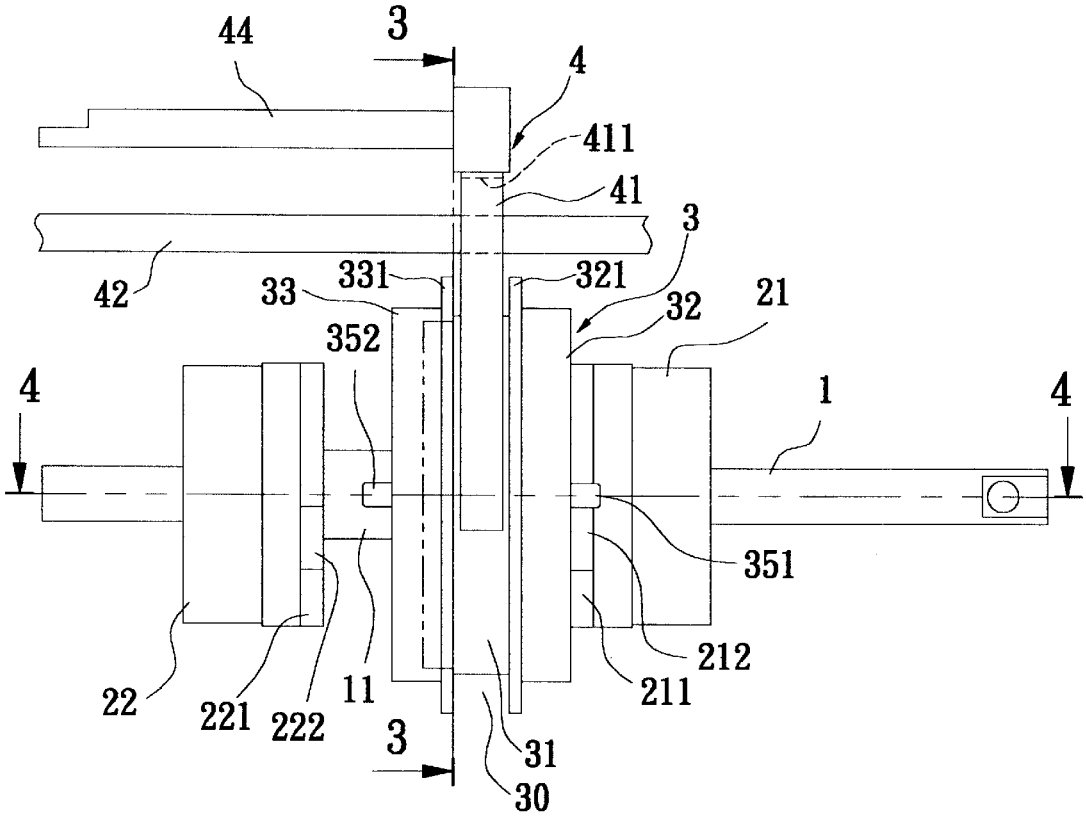
FIG. 2 is a plane assembled view of the present invention.
Figure 3:
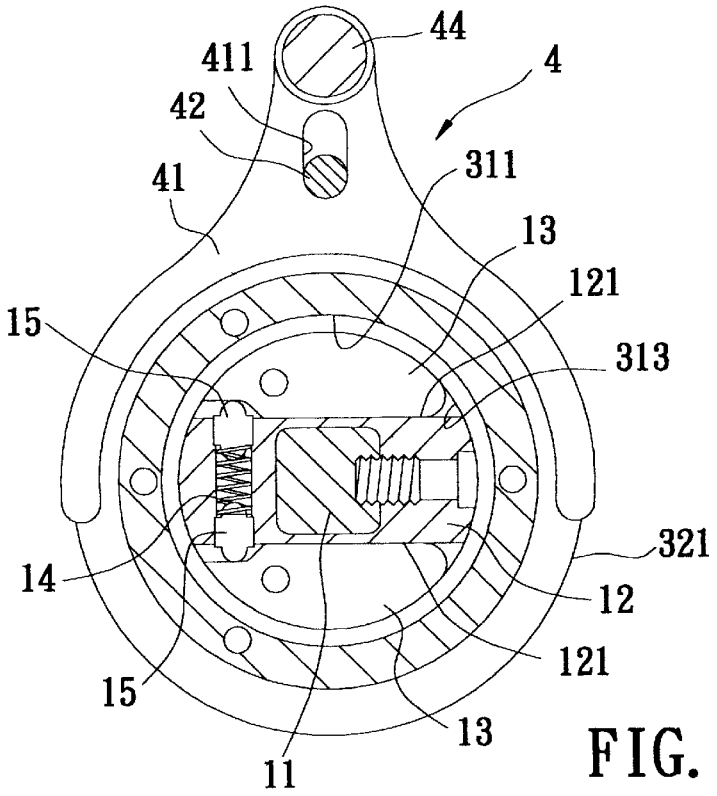
FIG. 3 is a sectional view taken along line 3—3 of FIG. 2.
Figure 4:
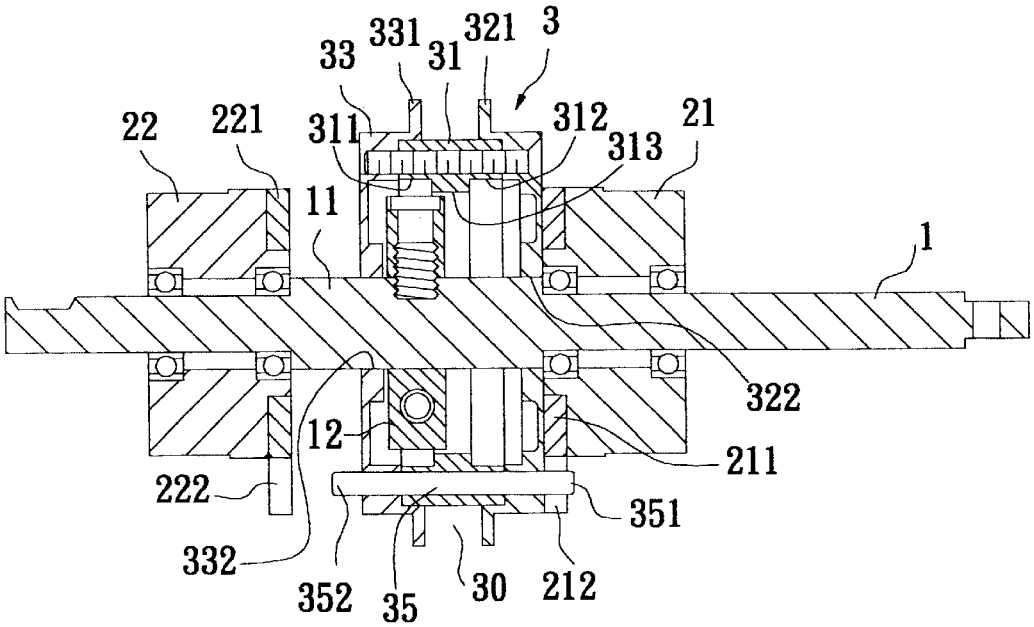
FIG. 4 is a sectional view taken along line 4—4 of FIG. 2.
Figure 5:
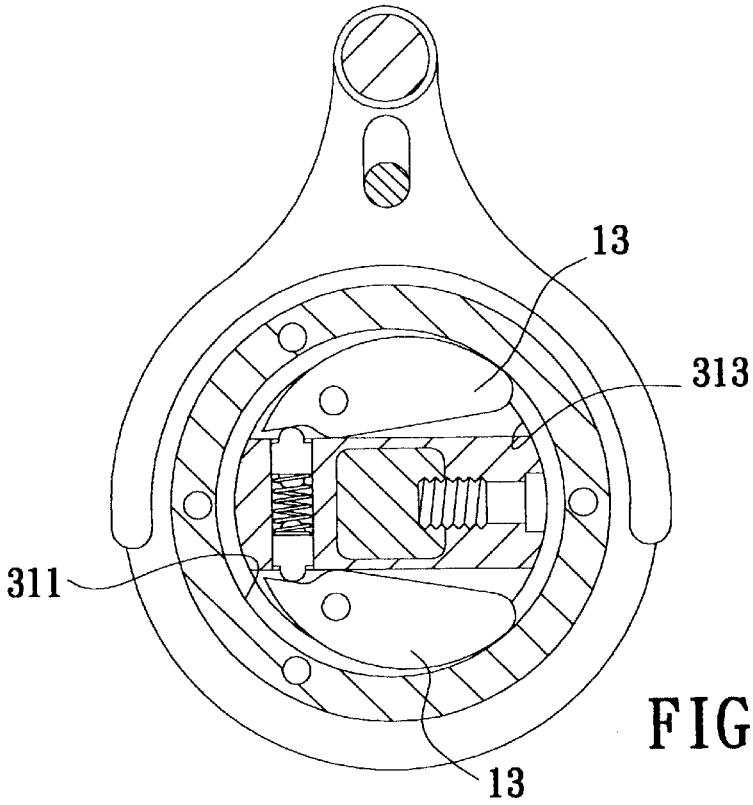
FIG. 5 is a cross-sectional view showing the operation of the present invention.
Figure 6:
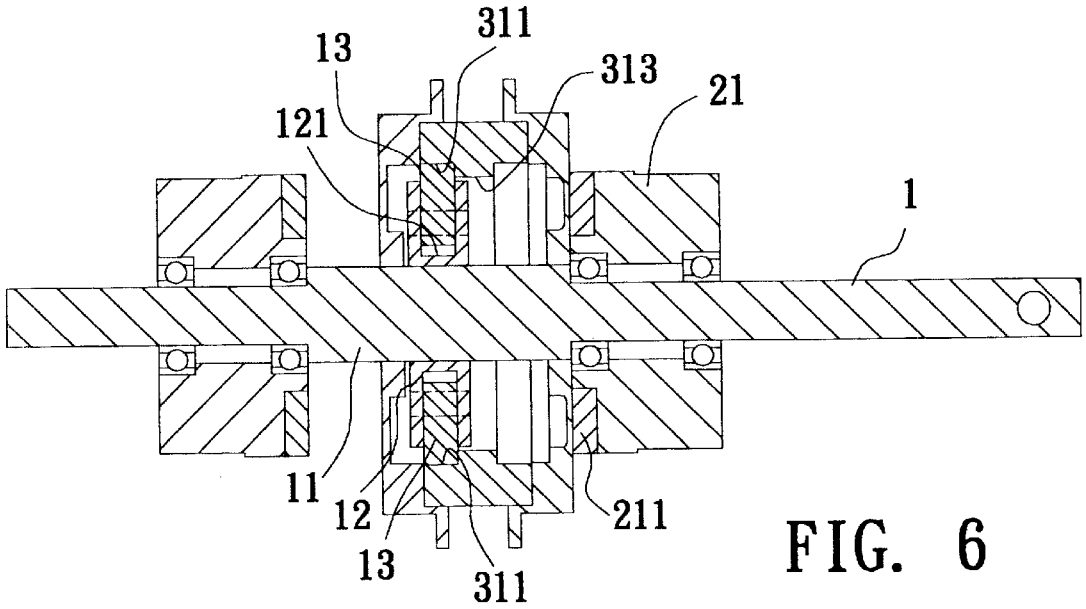
FIG. 6 is a longitudinal sectional view showing the operation of the present invention.
Figure 7:
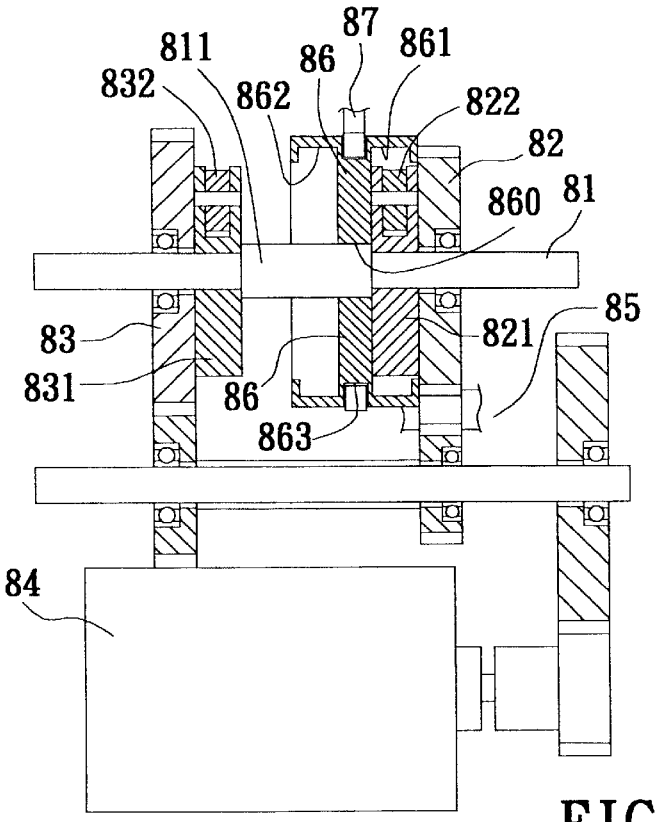
FIG. 7 PRIOR ART
FIG. 7 is a longitudinal sectional view showing a conventional forward/backward power coupler of a remotely controllable car.
Figure 8:
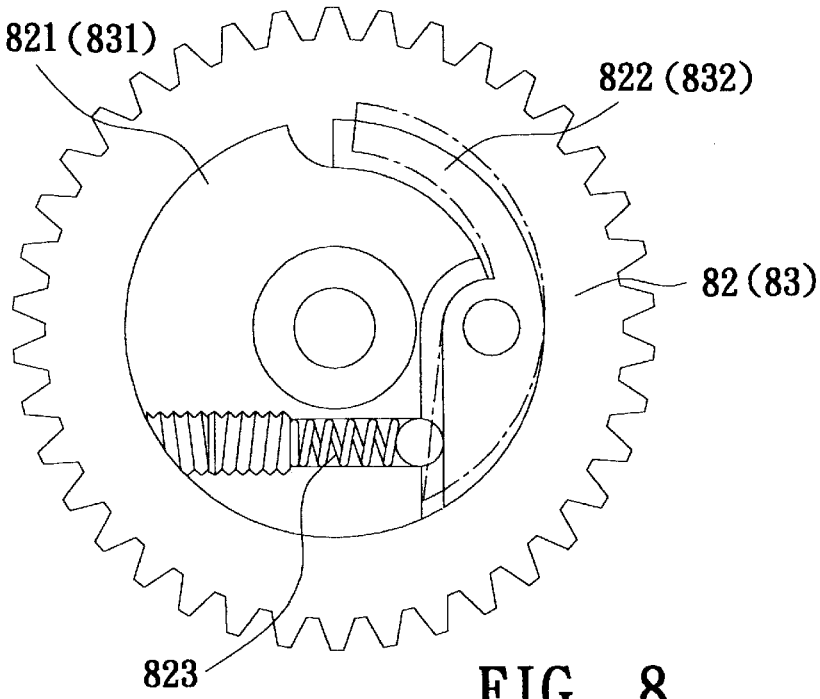
FIG. 8 PRIOR ART
FIG. 8 is a cross-sectional view showing the conventional forward/backward power coupler of the remotely controllable car.

In normal state, the shade body 3 abuts against the forward gear 21 as shown in FIGS. 2 and 4. When the engine drives the gear set (not shown) to drive the forward gear 21, the stop section 212 of the forward gear 21 will engage with the engaging section 351 of the shade body 3 to drive the shade body 3 for driving and rotating the output shaft 1. When the output shaft 1 rotates at a certain speed, the two throw plates 13 in the seat body 12 will be centrifugally extended outward and inserted into the annular grooves 311 as shown in FIGS. 5 and 6. At this time, the two throw plates 13 stop the stop wall 313 to restrict the shade body 3 from moving.

When changing the position of the shade body 3, only after the remotely controllable car decelerates to a certain speed, the two throw plates 13 of the seat body 12 will retract and restore into the receiving channels 121 of the seat body 12 without stopping the stop wall 313. At this time, the shade body 3 can be pushed by the shifting mechanism 4 to one side of the backward gear 22 and then driven by the stop section 222 of the backward gear 22 to backward rotate. That is, the switching time of the shade body 3 of the present invention is controlled by the rotational speed of the output shaft 1 instead of the rotational speed of the gear as in the conventional structure. Therefore, the respectively components are protected from being impacted and worn out due to instantaneous switching between forward and backward rotation.

Moreover, the differential section 11 of the output shaft 1 is accommodated in the differential engaging holes 322, 332 of the cover bodies 32, 33 and the engaging sections 351, 352 of the shade body 3 respectively engage with the stop sections 212, 222 of the forward and backward gears 21, 22. Therefore, the power can be truly and directly transmitted from the forward and backward gears via the shade body 3 to the output shaft 1.

Furthermore, the insertion member 41 of the shifting mechanism 4 is located by both the link 44 and the insertion rod 42. Therefore, the insertion member 41 will not deflect to contact with the shade body. Accordingly, when the output shaft rotates, he friction between the shade body and the insertion member is avoided.

The above embodiment is only used to illustrate the present invention, not intended to limit the scope thereof. Many modifications of the above embodiment can be made without departing from the spirit of the present invention.

What is claimed is:

1. A forward/backward switch protective structure for a remotely controllable car, comprising an output shaft having a differential section, two gears being respectively rotatably disposed at two ends of the differential section, one side of each gear adjacent to the differential section being provided with a stop section, a seat body being fixedly disposed on the differential section, two throw plates being pivotally disposed in the seat body, a hollow shade body being fitted on the differential section, the shade body being formed with an engaging hole corresponding to the cross-section of the differential section, whereby the differential section is fitted through the engaging hole, the shade body being controlled by a shifting mechanism and movable along the differential section, the shade body being formed with engaging sections respectively corresponding to the stop sections of the gears, whereby the shifting mechanism can drive the shade body to move, making the engaging sections respectively engage with the stop sections of the gears, the shade body being formed with an internal chamber in which a seat body is accommodated, the shade body being formed with annular grooves, whereby when the engaging sections respectively engage with the stop sections of the gears, the annular grooves respectively correspond to the throw plates of the seat body and when outward extended, the throw plates are inserted into the annular grooves.

2. The forward/backward switch protective structure for the remotely controllable car as claimed in claim 1, wherein the shifting mechanism includes an arched insertion member and the shade body is formed with two outward projecting annular stop walls spaced from each other, the two stop walls defining therebetween a rail for the insertion member to insert therein, the insertion member being connected with a link for driving the insertion member to push and move the shade body.

3. The forward/backward switch protective structure for the remotely controllable car as claimed in claim 1, wherein one side of each gear adjacent to the differential section is coupled with a stop board having a stop block radially outward projecting from the gear to form the stop section.

4. The forward/backward switch protective structure for the remotely controllable car as claimed in claim 1, wherein a rod is axially passed through the shade body corresponding to the stop sections of the gears, two ends of the rod extending out of the shade body to respectively form the engaging sections.

5. The forward/backward switch protective structure for remotely controllable car as claimed in claim 1, wherein the shade body includes a ring body two sides of which are coupled with two cover bodies, one side of each of the cover bodies adjacent to the ring body being formed with an annular stop wall, the two cover bodies and the ring body together defining the chamber and the annular groove.

* * * * *